US006296268B1

(12) United States Patent
Ford et al.

(10) Patent No.: US 6,296,268 B1
(45) Date of Patent: Oct. 2, 2001

(54) CONVERTIBLE WALKER/RIDER TOY FOR A CHILD

(75) Inventors: Jeffrey M. Ford, Providence; Craig J. McElhaney, Cumberland; Lee Spielberger, Warwick, all of RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/328,103

(22) Filed: Jun. 8, 1999

Related U.S. Application Data

(63) Continuation-in-part of application No. 29/105,448, filed on May 25, 1999, now Pat. No. Des. 424,126.

(51) Int. Cl.[7] ..... B62B 1/00; A45B 3/00; A61H 3/00

(52) U.S. Cl. ..... 280/648; 135/66; 135/67; 135/87.051

(58) Field of Search ..... 280/87.01, 87.021, 280/648, 658, 87.051, 828, 188, 293, 47.371; 446/471, 451; D12/30; D21/424; 135/66, 67, 72, 74, 65

(56) References Cited

U.S. PATENT DOCUMENTS

| | | | | |
|---|---|---|---|---|
| D. 321,216 | | 10/1991 | Pape et al. | D21/59 |
| D. 424,126 | * | 5/2000 | Goes et al. | D21/424 |
| 2,884,046 | * | 4/1959 | Patrick | 155/22 |
| 4,300,783 | | 11/1981 | Fisher | 280/87.02 |
| 4,799,700 | * | 1/1989 | Knoedler et al. | 280/87.051 |
| 5,362,272 | | 11/1994 | Chow et al. | 446/278 |
| 5,441,289 | | 8/1995 | Spielberger | 280/87.051 |
| 5,499,835 | | 3/1996 | Skirchak, Jr. et al. | 280/293 |
| 5,788,253 | | 8/1998 | Thomson et al. | 280/87.041 |

* cited by examiner

*Primary Examiner*—Brian L. Johnson
*Assistant Examiner*—G. B. Klebe
(74) *Attorney, Agent, or Firm*—Barlow, Josephs & Holmes

(57) ABSTRACT

An improved toy assembly is adapted to be alternatively used as a foot-to-floor ride-on vehicle, or as a walker. The convertible walker/rider toy includes a chassis which is supported on a plurality of wheels, and a body that is pivotally attached to the front end of the chassis. The body includes a contoured upper surface that functions as a seat when the toy is assembled in the rider configuration. The toy further includes an L-shaped handlebar having a rider portion and a walker portion which are joined at approximately a 90° angle. The walker portion of the handlebar is pivotally attached to the rear end of the body and is pivotally movable relative to the body. When the toy is in the rider configuration, the body overlies the chassis, the walker portion of the handlebar is received beneath the body and the rider portion of the handlebar projects upwardly through the opening in the front end of the body. To reconfigure the toy into the walker mode, the rear end of the body is lifted upwardly, and the handlebar is pivoted rearwardly so that the rider handlebar portion is retracted through the opening in the body. A latching assembly is alternately engageable with the body and the handlebar for releasably securing the toy in the rider and walker configurations, respectively.

20 Claims, 12 Drawing Sheets

CONVERTIBLE WALKER/RIDER TOY FOR A CHILD

This application is a continuation-in-part of U.S. Pat. Application No. 29/105,448, filed May 25, 1999, now U.S. Design Patent No. D421,126 issued May 2, 2000.

BACKGROUND AND SUMMARY OF THE INVENTION

The instant invention relates to developmental toys for toddler age children, and more particularly to a multi-functional toy which is convertible between a foot-to-floor ride-on vehicle, and an upright walker.

It is widely recognized that walkers can be effective in accelerating the development of walking skills in toddler age children, and accordingly, a relatively large number of different types of walker apparatus have been heretofore available. Despite the well documented benefits derived from utilizing walkers for aiding in the development of walking skills in toddler age children, the actual period of time during which a walker is used by a child in the development of his or her walking skills can be relatively short. Therefore, in many cases, unless a walker can be passed on to another child, the period during which it can be effectively used can be quite limited. In this regard, a variety of different walker configurations, and convertible walker devices have been developed in an attempt to lengthen the useful life span of these types of products. For example, the walker disclosed in the U.S. Pat. No. 5,441,289 to Spielberger provides an apparatus which is adapted to be alternatively used as a walker or as a foot-to-floor ride-on vehicle, and which therefore has an increased period of usefulness in the development and growth of a child. As a further example, the U.S. Pat. No. 5,362,272 to Chow et al discloses a walker toy that can be collapsed into a rolling activity toy, thus extending the life span of the product for some period of time. While the above-noted products are useful for their intended purposes, there is nevertheless an ongoing consumer desire and need for improved developmental products which have an extended overall useful life.

The instant invention provides an improved toy assembly which is adapted to be alternatively used as a foot-to-floor ride-on vehicle, or as a walker, and which thus has an increased useful life span for the child. The walker/rider toy is further provided with a plurality of amusing vehicle like components which are further effective for extending the attentive period during which a child is likely to use the toy and thus the useful life span of the product.

The convertible walker/rider toy of instant invention comprises a chassis of generally V-shaped configuration which is supported in a generally horizontal disposition on a plurality of wheels. The V-shaped chassis is adapted so that the closed end portion thereof defines the front end of the vehicle, so that the legs define the sides of the vehicle, and so that the open end of thereof defines the rear end of the vehicle. When the toy is used as a walker, the child effectively stands at the rear of the chassis and the child's feet are situated between the legs of the chassis. The toy further comprises a generally pear-shaped body which is pivotally attached to the front end of the chassis. The body includes a contoured upper surface which is configured and arranged to function as a seat when the toy is assembled in the rider configuration. The upper surface of the body further includes a plurality of vehicle type components mounted thereon. The body is pivotally movable between a first rider position wherein the body is disposed in a generally horizontal position overlying the chassis, and a second upright, or walker, position wherein the rear end of the body is pivoted upwardly at an angle to the chassis. The toy further comprises an L-shaped handlebar having a rider portion and a walker portion which are joined at approximately a 90° angle. The walker portion of the handlebar is pivotally attached to the underside of the rear end of the body and is pivotally movable between a first rider position wherein the walker portion of the handlebar extends beneath the body between the body and the chassis, and the rider portion projects upwardly through an opening in the front end of the body, and a second walker position wherein the walker handlebar is pivoted rearwardly away form the body so that the rider handlebar portion a is retracted through the opening in the body.

In other words, when the toy is in the rider configuration, the body is disposed in a generally horizontal position on top of the chassis, the walker handlebar portion is received beneath the body between the chassis and the body, and the rider handlebar portion projects upwardly through the opening in the front end of the body. To reconfigure the toy into the walker mode, the rear end of the body is lifted upwardly, and the handlebar is pivoted rearwardly so that the rider handlebar portion is retracted through the opening in the body.

The convertible walker/rider toy further includes a latching assembly which is alternately engageable with a first latch opening in the walker portion of the handlebar and a second latch opening in the elbow joint of the handlebar for releasably securing the toy in the rider and walker configurations, respectively.

Accordingly, among the objects of the instant invention are: the provision of a developmental toy apparatus which is alternatively operable as a walker for a toddler age child, or as a foot-to-floor ride-on vehicle; the provision of such a toy which has an extended useful life as a result of being convertible from a rider configuration to a walker configuration; the provision of a convertible walker/rider toy comprising a chassis, a body which is pivotally mounted on the chassis, and a handlebar which is pivotally mounted to the body, and the provision of such a convertible walker/rider toy wherein the body and handlebar are alternatively secured in first and second positions to configure the toy either as a walker or a ride-on vehicle.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
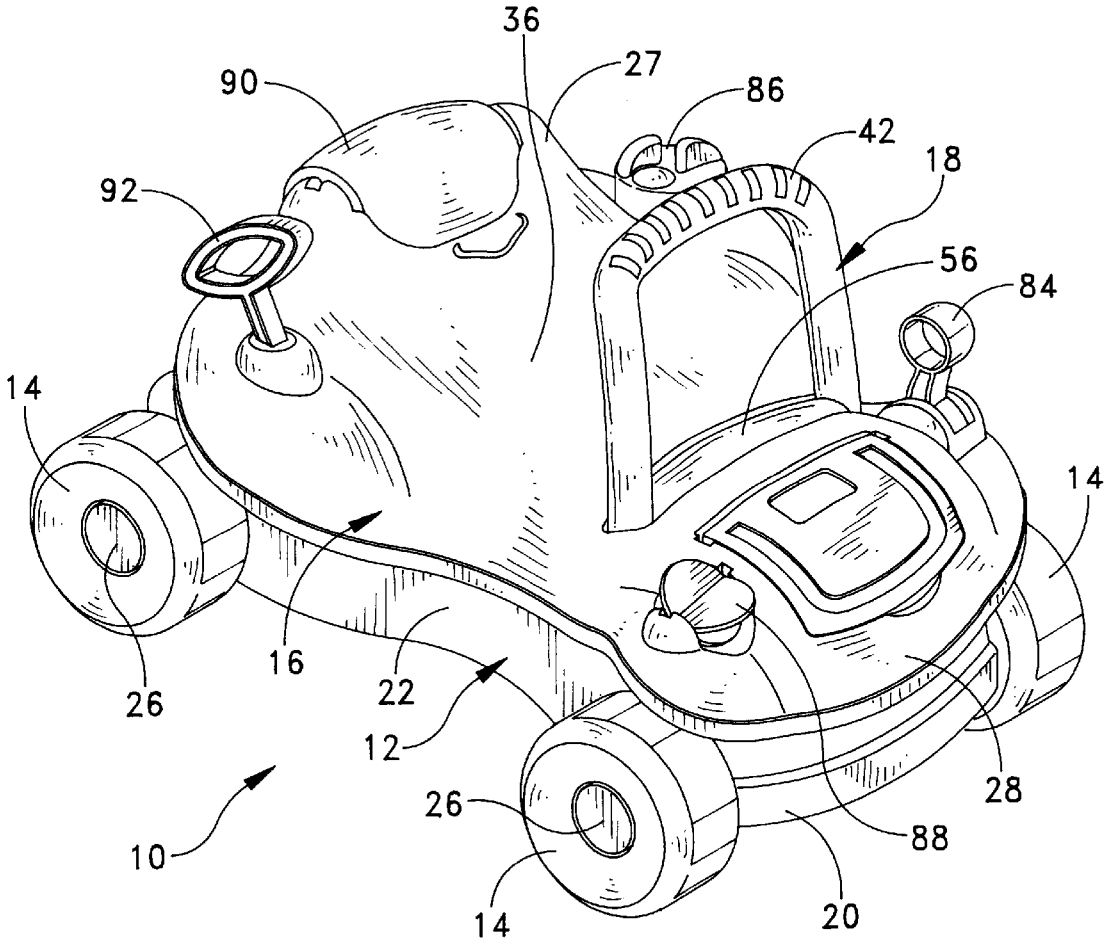
FIG. 1 is a perspective view of the convertible walker/rider toy of the instant invention with the toy configured in the rider mode.
Figure 2:
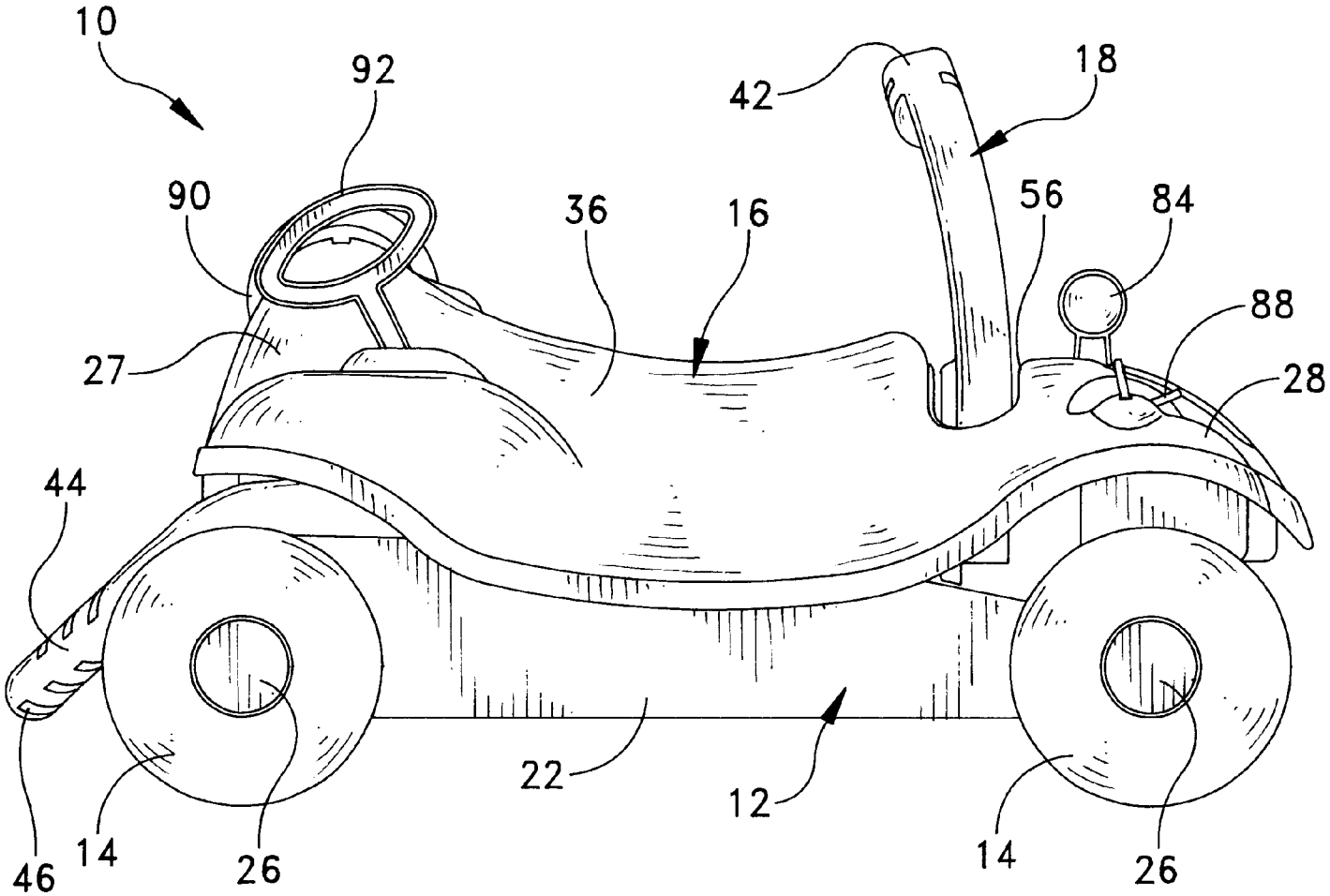
FIG. 2 is a side view thereof.
Figure 3:
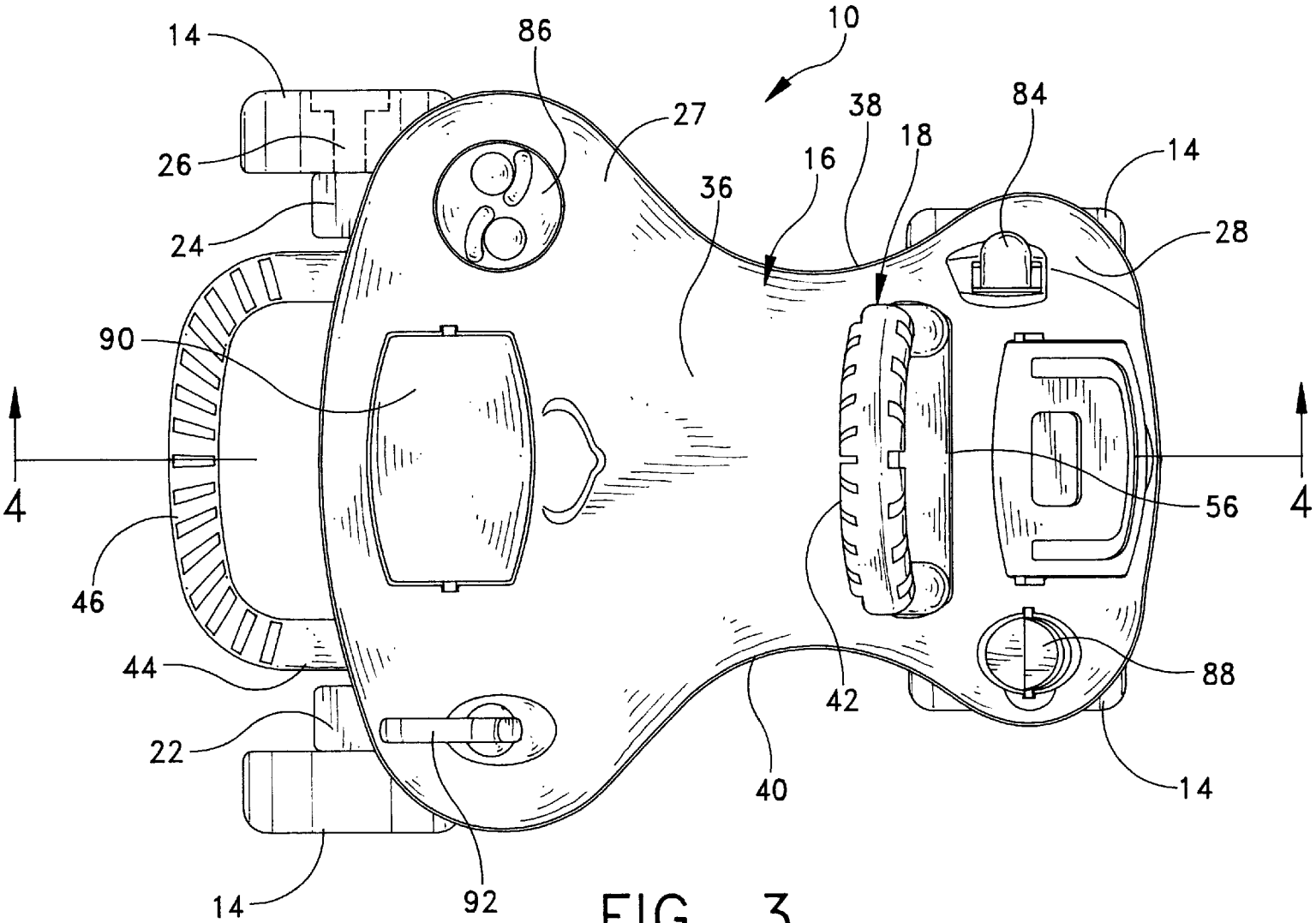
FIG. 3 is a top view thereof.
Figure 3A:
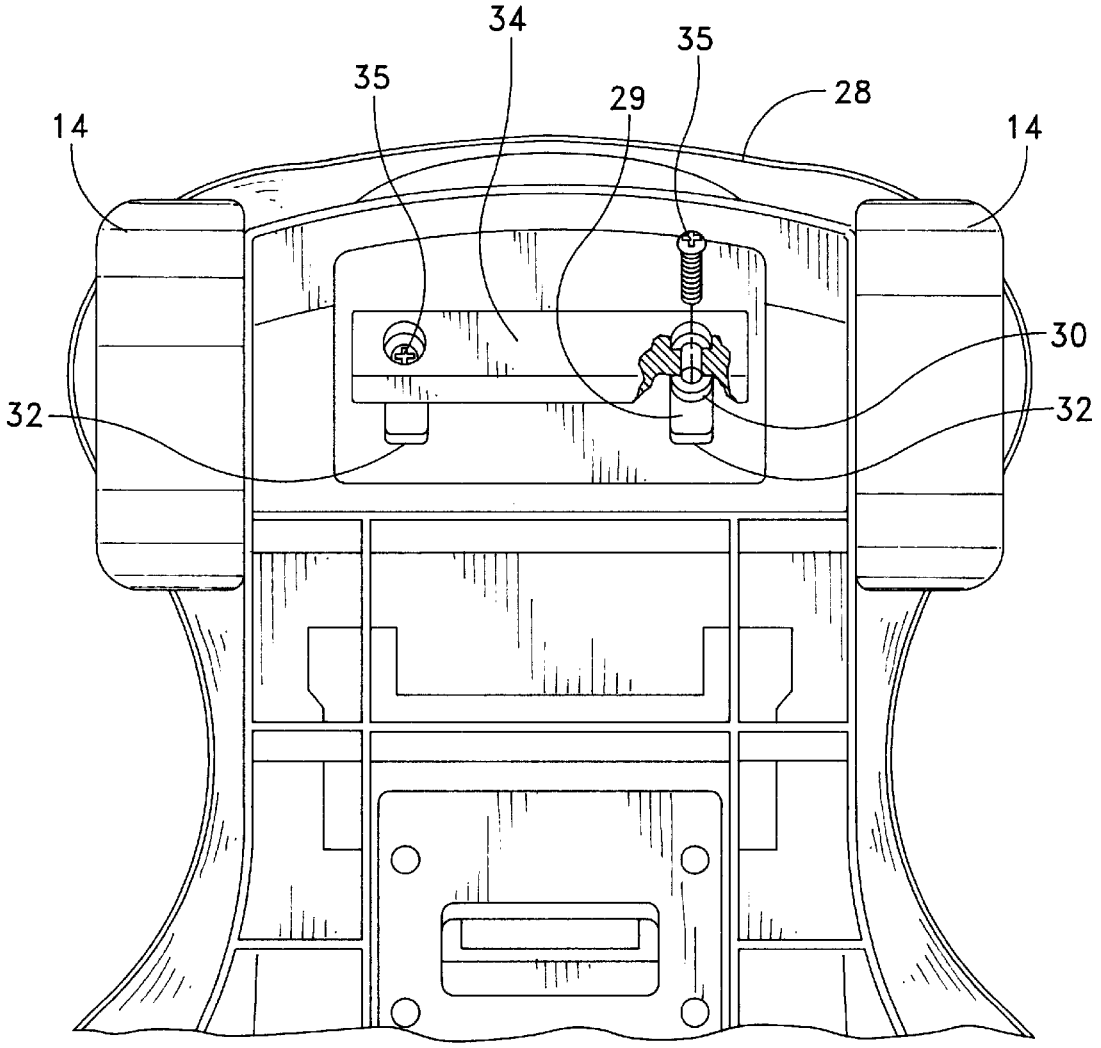
FIG. 3A is a bottom view thereof.

Referring now to the drawings, the convertible walker/rider toy of the instant invention is illustrated and generally indicated at 10 in FIGS. 1–10. As will hereinafter be more fully described, the instant invention provides an improved toy assembly 10 which is adapted to be alternatively used as a foot-to-floor ride-on vehicle (FIG. 1), or as a walker (FIG. 10), and which thus has an increased usefull life span for the child.

Unless otherwise indicated herein, it is to be understood that the various components of the present invention are preferably molded or formed from a plastic material which is of sufficient durability and safety so as to be usable with children of toddler age.

Figure 10:
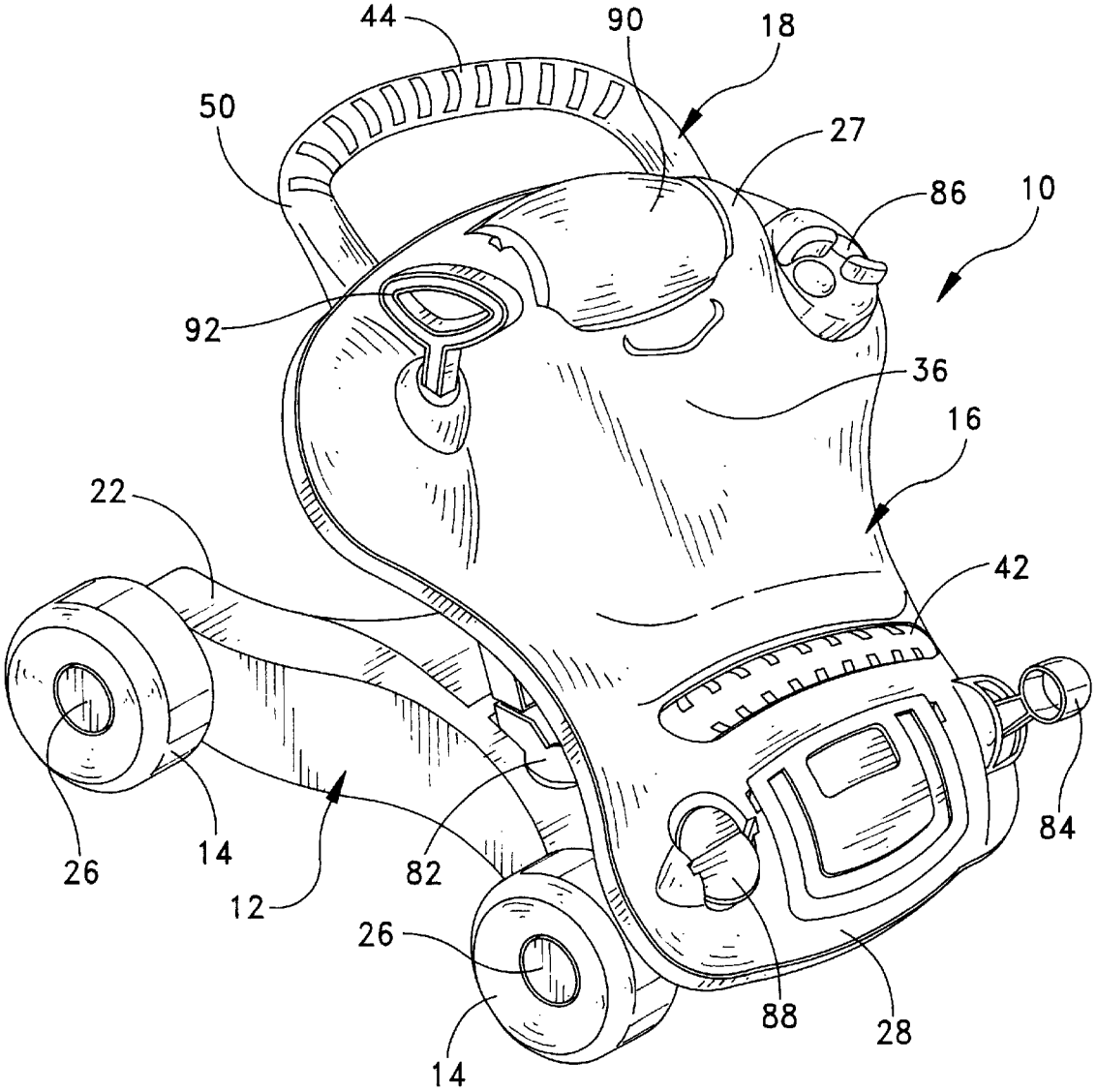
FIG. 10 is a front perspective view thereof showing the toy configured in the walker mode.

The convertible walker/rider toy of comprises a V-shaped chassis generally indicated at 12, which is supported in a generally horizontal disposition on a plurality of wheel elements 14, a body generally indicated at 16, and a handlebar generally indicated at 18. The chassis 12, body 16 and handlebar 18 are adapted to enable the body 16 and handlebar 18 to be alternately configured in a first rider configuration as illustrated in FIG. 1, or in a second walker configuration as illustrated in FIG. 10. When the body 16 and handlebar 18 are configured in the first rider position (FIG. 1), the body 16 provides a seat and a rider portion of the handlebar 18 provides a hand hold for the child to grasp while seated on the body 16 and to thus enable the toy to be used as a foot-to-floor ride-on vehicle. Alternatively, when the body 16 and handlebar 18 are configured in the second walker configuration (FIG. 10), the body 16 is tilted upright, and a walker portion of the handlebar 18 is presented at the toddler's chest level enabling the toy to be used as an upright walker for aiding the toddler age child in the development of walking skills.

Figure 11:
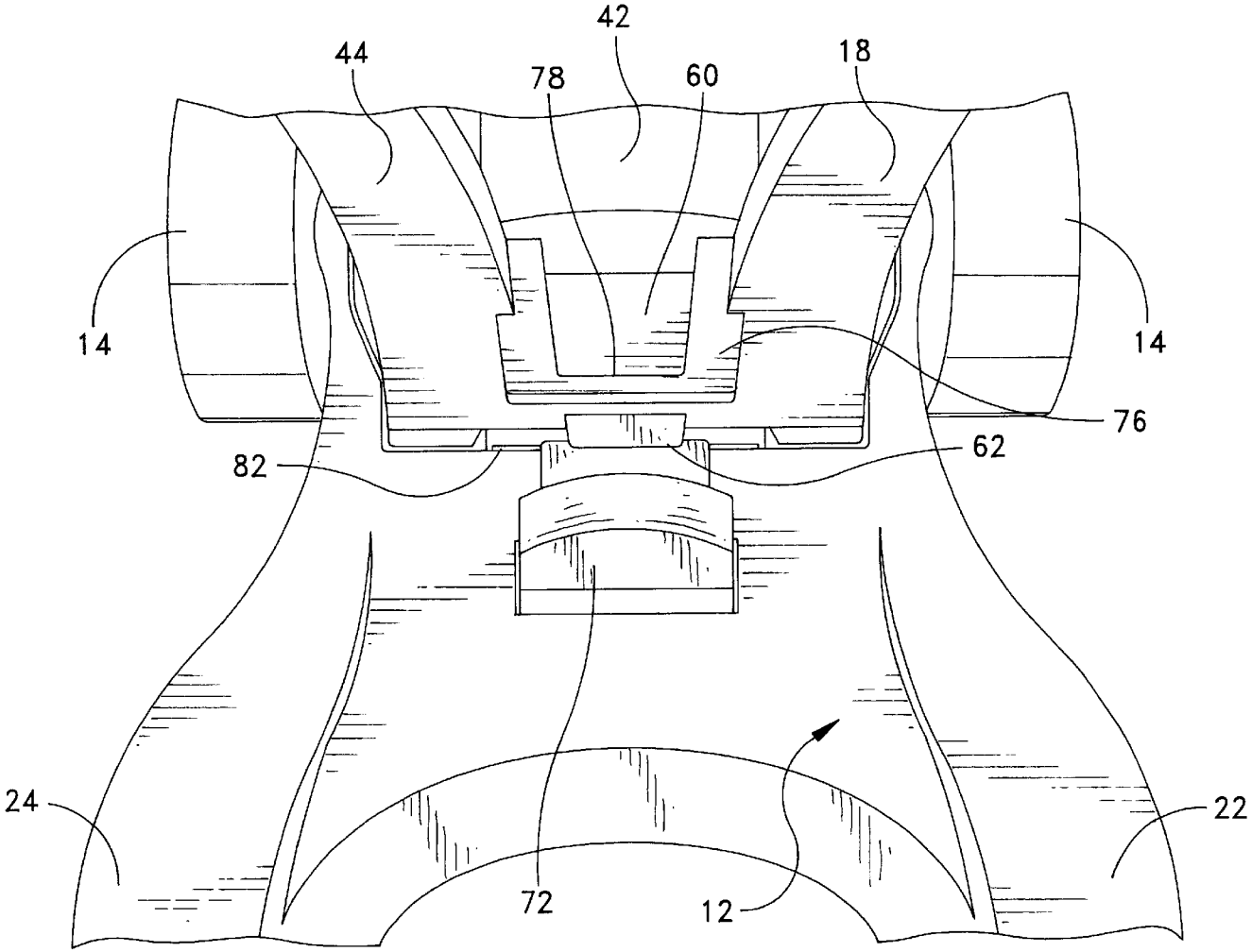
FIG. 11 is a rear perspective view thereof showing the toy configured in the walker mode.

The V-shaped chassis 12 includes a closed end portion 20 which defines the front end of the vehicle, and two opposing legs 22, 24 that extend rearwardly from the front end portion 20 to define the sides of the vehicle. The open end of the chassis 12 defines the rear end of the vehicle. In this configuration, when the toy 10 is used as a walker, the child effectively stands at the rear of the chassis and the child's feet are situated between the legs of the chassis (See FIG. 11).

The wheel elements 14 are all identical in construction, each wheel element 14 being rotatably mounted on respective independent axle element 26 which is integrally formed with the chassis 12. The wheel elements 14 and axle elements 26 include interengaging snap formations for assembly thereof.

The body 16 is constructed in a generally pear-shaped configuration with the larger end thereof defining the rear end 27 of the body 16 and the smaller end defining the front end 28 thereof. The front end 28 of the body 16 is pivotally attached to the front end 20 of the chassis 12, and in this regard, the underside of the body 16 includes an arm 29 that extends downwardly therefrom. The arm 29 includes a pair of spaced posts 30 that extend through a respective pair of slots 32 formed in a seat 33 at the front end 20 of the chassis 12. The posts 30 are maintained in assembled sliding relation with the slots 32 by a retaining bracket 34 positioned on the underside of the chassis 12. A pair of fasteners 35 extend through the retaining bracket 34 and into the ends of the posts 30 to capture the posts 30 within the slots 32. The posts 30 and slots 32 create a pivot upon which the front end 32 of the body 16 rotates relative to the chassis 12. The body 16 further includes a contoured upper surface 36 which is configured and arranged to function as a seat when the toy 10 is assembled in the rider configuration. In conjunction with being substantially pear shaped, the sides of the body 16 include arcuate recesses 38, 40 which are intended to accommodate the legs of a toddler when seated on the body 16 (See FIG. 3). The recesses 38, 40 allow the child's feet to more easily engage the floor in the rider mode. The body 16 is pivotally movable between a first rider position (FIGS. 1–6) wherein the body 16 is disposed in a generally horizontal position overlying the chassis 12, and a second upright, or walker, position (FIGS. 7–10) wherein the rear end 27 of the body 16 is pivoted upwardly at an angle to the chassis 12.

The handlebar 18 comprises a U-shaped rider portion 42 and a U-shaped walker portion 44 which are joined in an L-shaped configuration at approximately a 90° angle. It is to be understood that the angle identified herein is intended to represent a preferred embodiment and that the angle is not critical to the functionality of the toy. The angle could be greater or lesser depending on the configurations of the chassis 12, body 16, and other elements of the toy. More specifically, the rider portion 42 and the walker portion 44 are joined by a pivot pin 46 at an elbow junction generally indicated at 48. The pin 46 does not actually allow rotation of the rider portion 42 relative to the walker portion 44, but does permit some slight relative movement to facilitate movement of the handlebar 18 and latching thereof, which will be described at a later point in the specification. The distal end 50 of the walker portion 44 of the handlebar is pivotally attached to the underside of the rear end 27 of the body 16 by a pin 52 which passes through a bore 54 in the underside of the body 16 and further passes through aligned openings (not shown) in the arms of the U-shaped walker portion 44 of the handlebar 18. The handlebar 18 is pivotally movable between a first rider position (See FIG. 4) wherein the walker portion 44 of the handlebar extends beneath the body 16 between the body 16 and the chassis 12, and the rider portion 42 projects upwardly through an opening 54 in the front end 28 of the body 16, and a second walker position (See FIG. 8) wherein the walker portion 44 of the handlebar 18 is pivoted rearwardly away form the body 16 and the rider handlebar portion 42 is retracted through the opening 54 in the body 16.

Figure 5:
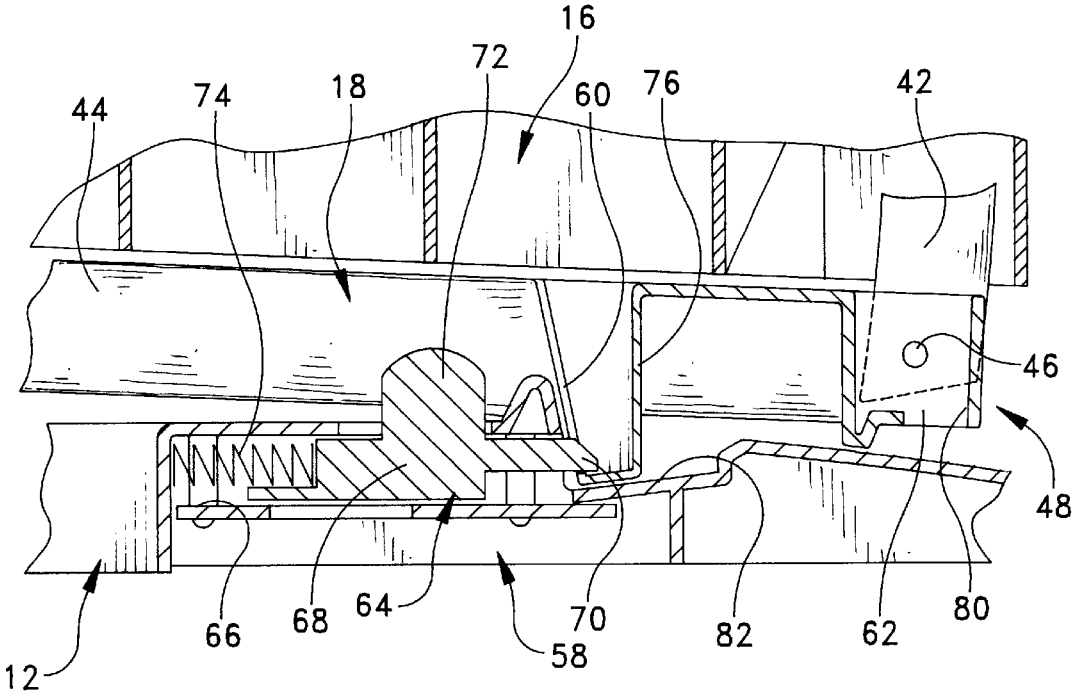
FIG. 5 is an enlarged cross-sectional view of the latching mechanism showing latching of the handlebar in the rider configuration.
Figure 6:
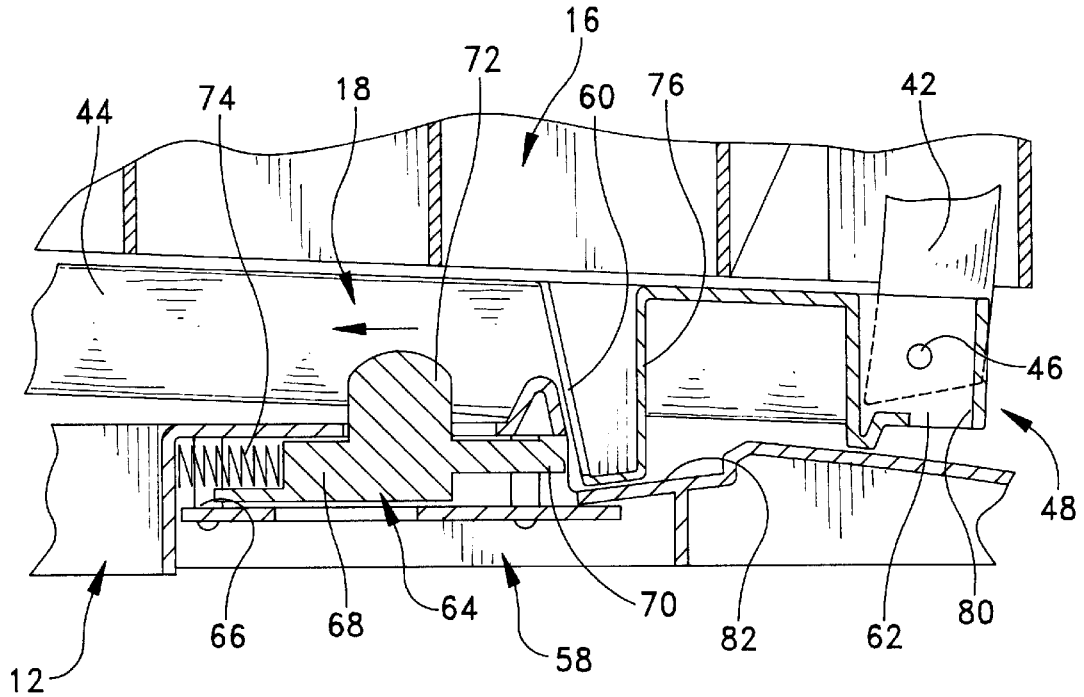
FIG. 6 is a similar view thereof with the latch member retracted for reconfiguration of the toy to the walker mode.
Figure 7A:
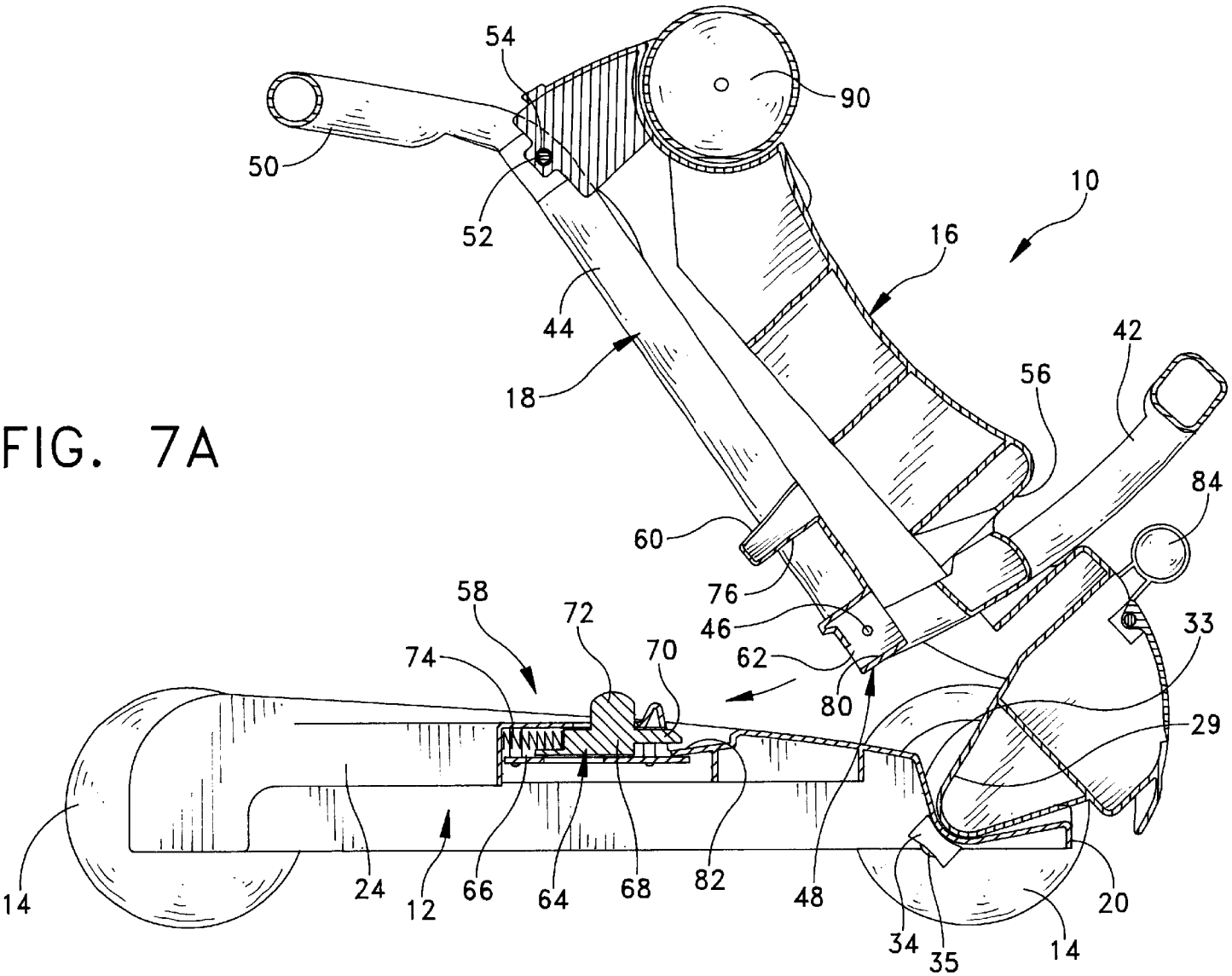
FIG. 7A is another cross-sectional view thereof with the body pivoted away from the chassis.
Figure 7B:
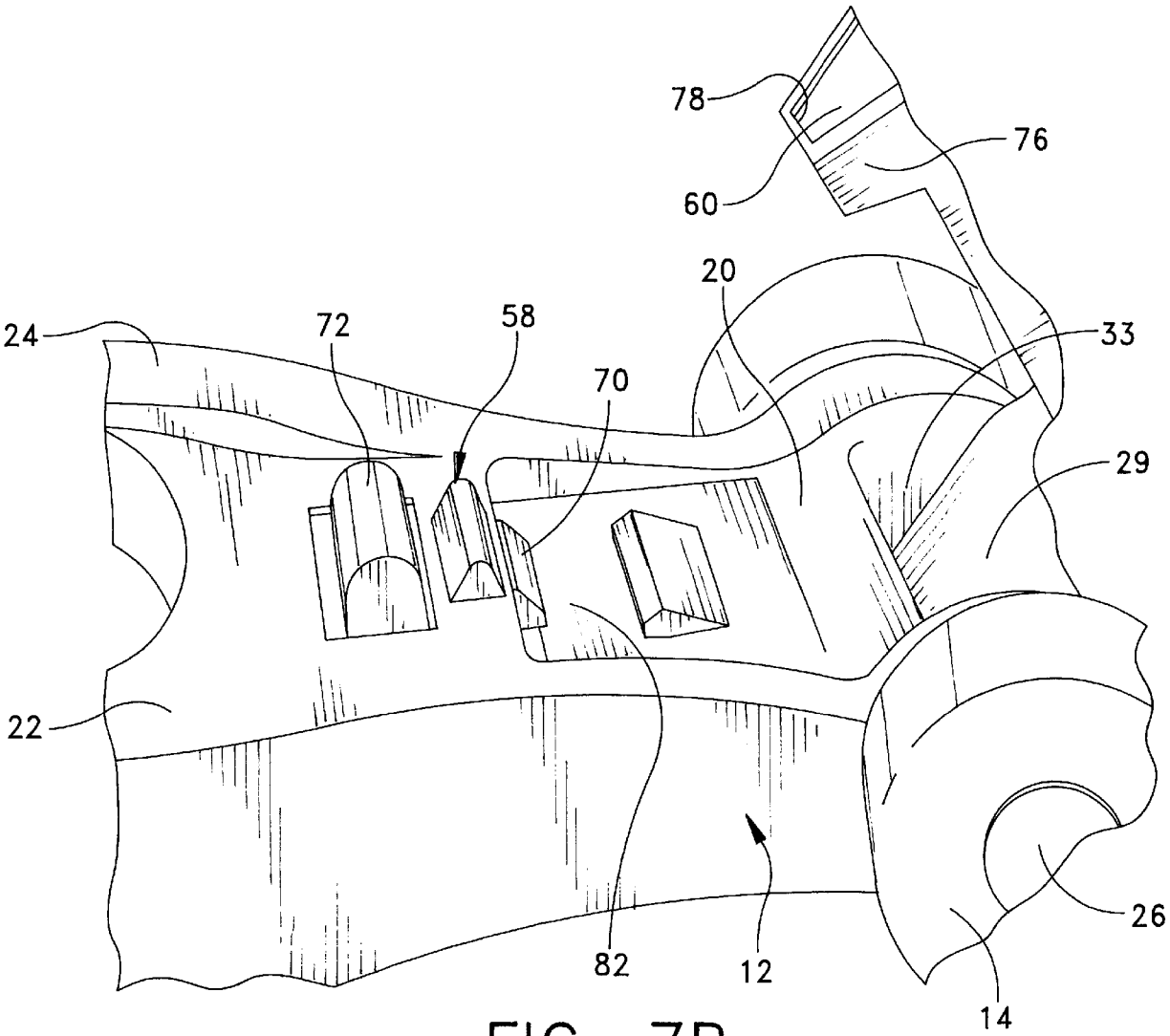
FIG. 7B is an enlarged perspective view from the side, showing the latching member on the top surface of the chassis.

The convertible walker/rider toy 10 further includes a latching assembly generally indicated at 58 which is alternately engageable with a first latch opening 60 in the walker portion 44 of the handlebar 18 and a second latch opening 62 in the elbow joint 48 of the handlebar 18 for releasably securing the toy 10 in the rider and walker configurations, respectively. The latching assembly 58 comprises a latch member generally indicated at 64 slidably mounted within a channel 66 that is centrally located on the upper surface of the chassis 12. The latch member 64 includes a body 68, an engagement pin 70 and an actuator handle 72 which is operable for manually sliding the latch member 64 within the channel 66 between an extended position as illustrated in FIG. 5, and a retracted position as illustrated in FIG. 6. A spring 74 normally biases the latch member 64 to the extended position. The first latch opening 60 is formed in a leg 76 which projects downwardly from walker portion 44 of the handlebar 18. When the body 16 is in the rider configuration, the engagement pin 70 extends into the opening 60 and engages with the bottom wall 78 of the leg 76 to latch the toy 10 in the first, or rider, configuration. The second latch opening 62 is also formed in the handlebar 18 at the elbow joint 48 between the walker portion 44 and the rider portion 42 thereof When the handlebar 18 is moved into the walker configuration, the engagement pin 70 extends into the opening 62 and engages with a side wall 80 of the joint to latch the toy 10 in the walker configuration (See FIGS. 8 and 9). More specifically, the elbow joint 48 is seated in a recess 82 formed in the upper surface of the chassis 12. When the engagement pin 70 is extended into the opening 62, the elbow joint 48 is captured within the recess 82 by the pin 70.

The walker/rider toy 10 is further provided with a plurality of amusing components which are further effective for extending the attentive period during which a child is likely to use the toy and thus the useful life span of the product. The components include a shifter 84, a turn wheel 86, a paddle wheel 88, a rolling pin 90, and a pull handle 92.

Figure 4:
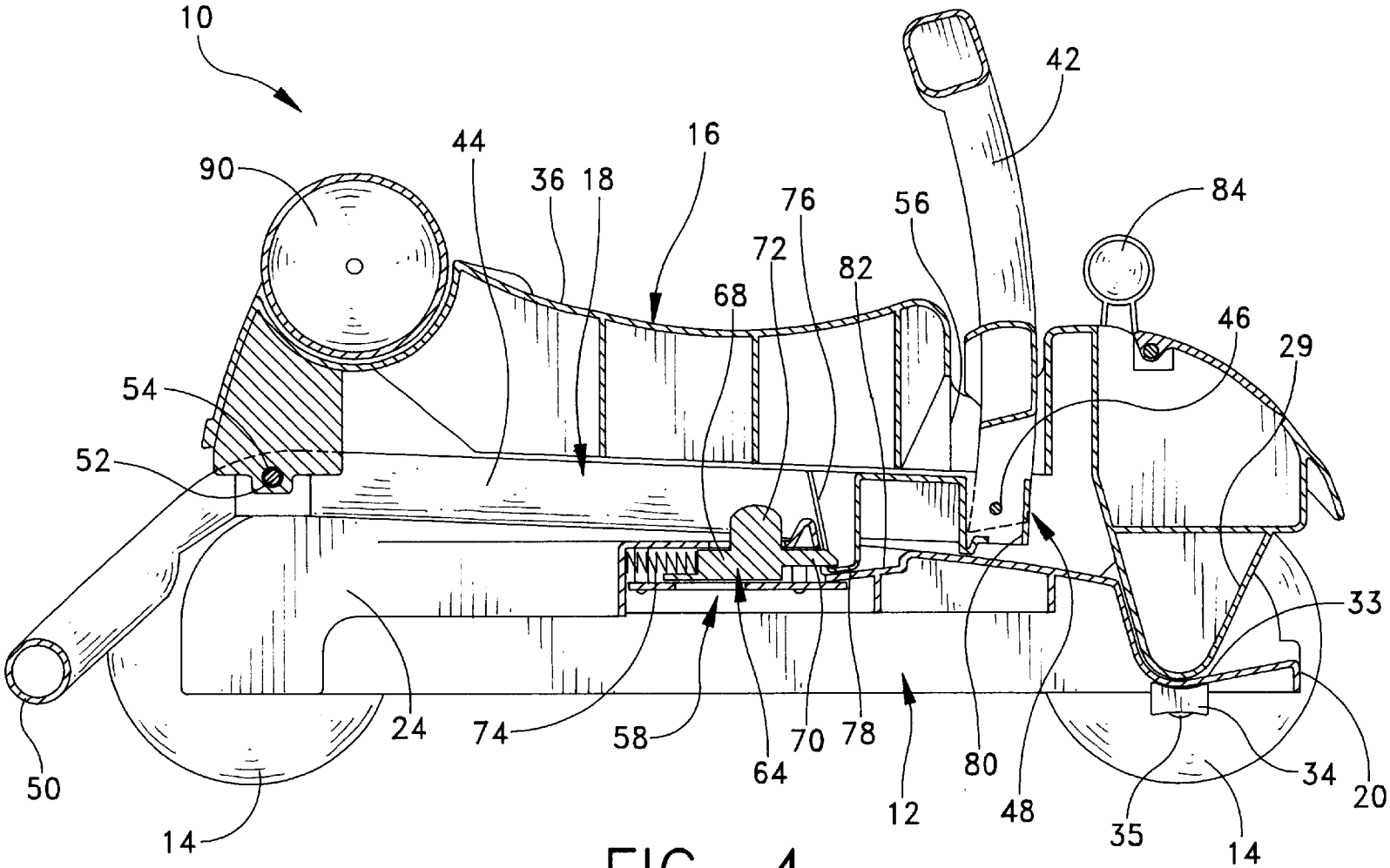
FIG. 4 is a cross-sectional view thereof as taken along line 4—4 of FIG. 3.
Figure 8:
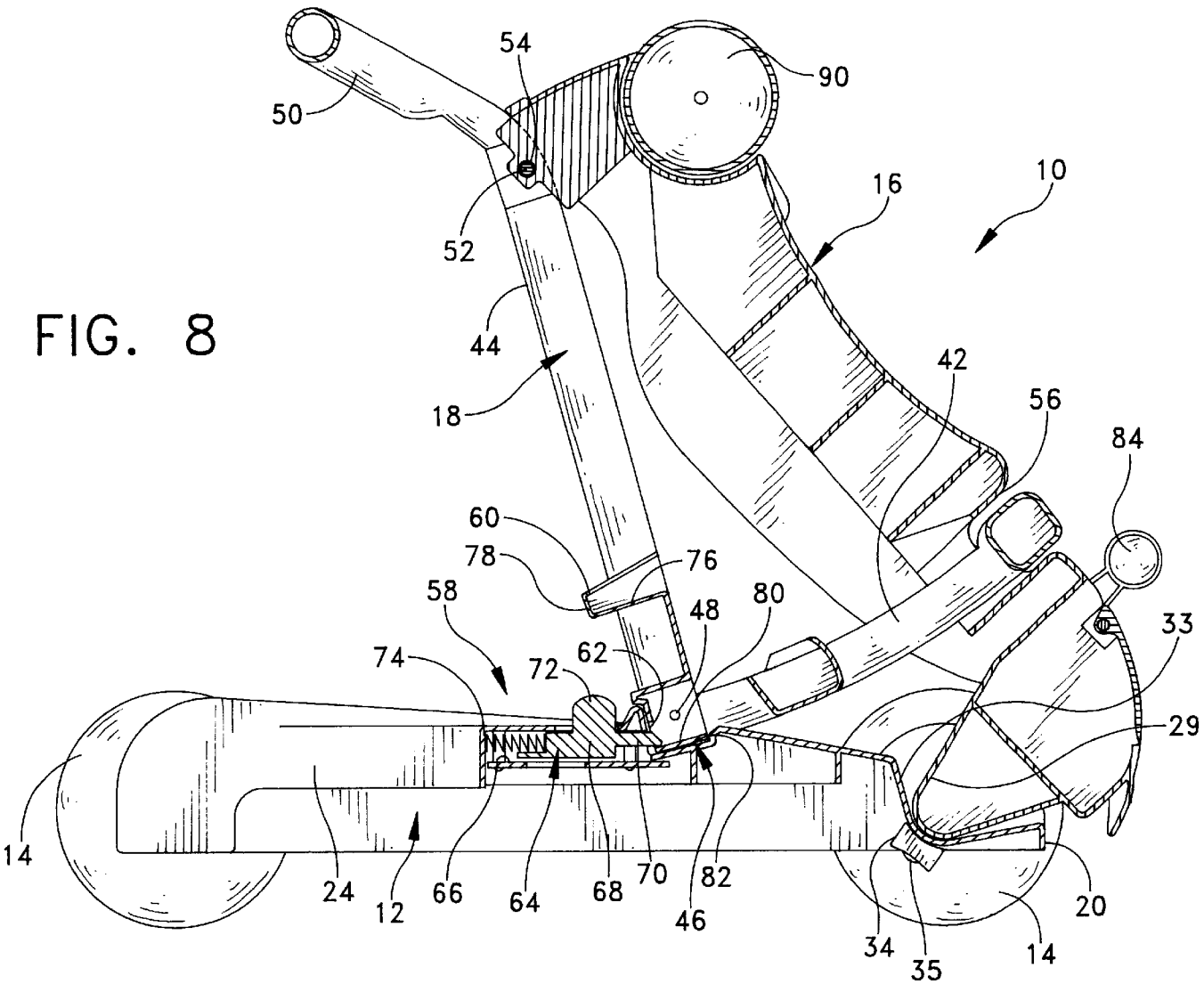
FIG. 8 is yet another cross-sectional view thereof with the handlebar pivoted into engagement with the latching assembly for latching the toy in the walker configuration.
Figure 9:
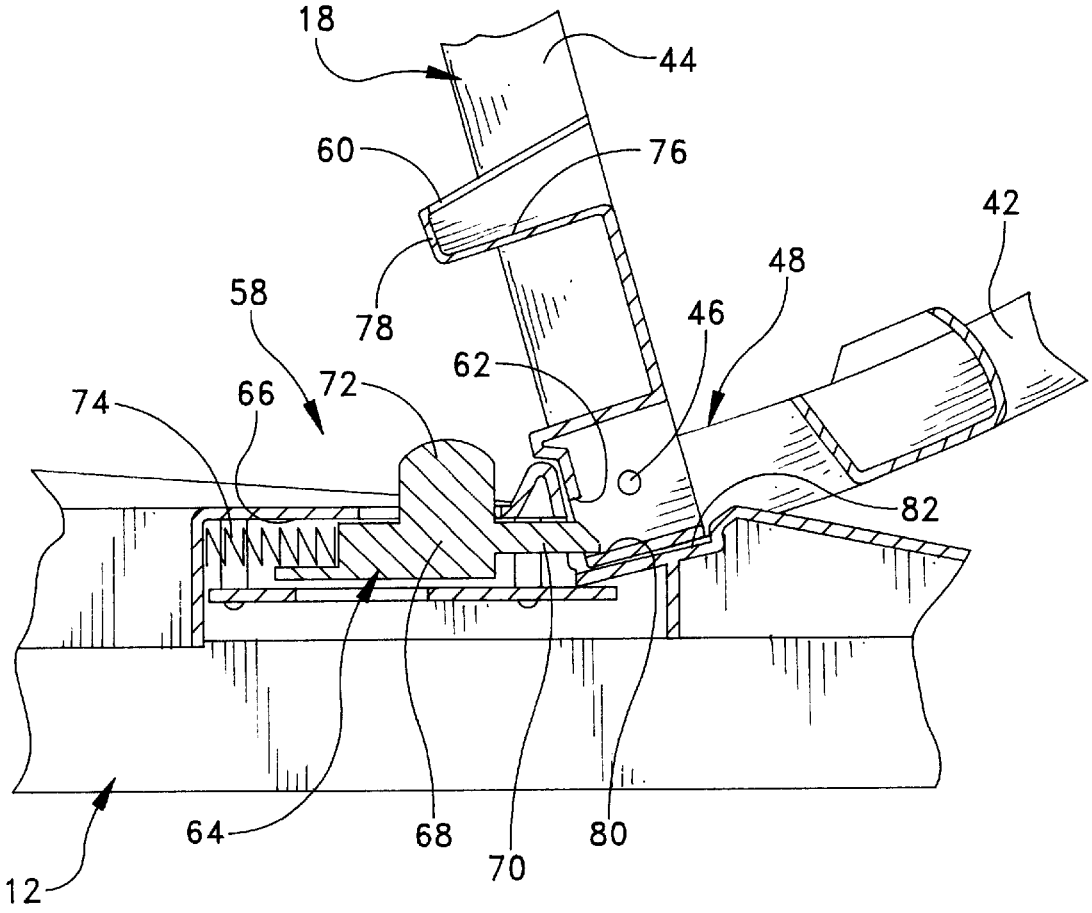
FIG. 9 is an enlarged cross-sectional view of the latching mechanism showing latching of the handlebar in the walker configuration.

Turning to FIGS. 4–10, for use of the toy in the rider configuration, the body 16 is disposed in a generally horizontal position on top of the chassis 12, the walker portion 44 of the handlebar 18 is received beneath the body 16 between the chassis 12 and the body 16, and the rider portion 42 of the handlebar 18 projects upwardly through the opening 56 in the front end 28 of the body 16. As can be seen in FIGS. 4–5, the engagement pin 70 extends into the opening 60 in the leg 76. To reconfigure the toy 10 into the walker mode, the latch member 64 is retracted (FIG. 5) to release the handlebar 18 and body 16, the rear end 27 of the body 16 is lifted upwardly (FIG. 7), and the handlebar 18 is pivoted rearwardly (FIG. 8) so that the rider portion 42 of the handlebar 18 is retracted through the opening 56 in the body 16. As can be seen in FIGS. 8 and 9, the engagement pin 70 extends into the opening 62 in the elbow joint 46 to capture the elbow 46 within the recess 82. The toy 10 can be converted back to the rider by releasing the latch assembly 58, and reversing the above.

It can therefore be seen that the instant invention provides a unique and improved developmental toy apparatus 10 which is alternatively operable as a walker for a toddler age child or as a foot-to-floor ride-on vehicle, and which, as a result of being convertible from a rider configuration to a walker configuration, has an extended useful life. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A convertible walker/rider toy for a child comprising:

a chassis having front and rear ends;

a plurality of wheels attached to said chassis for rotatably supporting said chassis on a supporting surface;

a body having front and rear ends, said body being pivotally attached to said chassis adjacent said front end of said chassis, said body being pivotally movable between a first riding position wherein said body at least partially overlies said chassis, and a second walker position wherein the rear end of the body is pivoted upwardly so that the chassis and the body are disposed at an angle; and a handlebar having a walker portion and a rider portion which are joined in an L-shaped configuration, said walker portion of said handlebar being pivotally attached to said body adjacent said rear end of said body, said rider portion of said handlebar being received through an opening in the body adjacent the front end of the body, said handlebar being pivotally movable between a first rider position wherein the walker portion of the handlebar extends beneath the body between the body and the chassis and the rider portion projects upwardly through the opening in the front end of the body, and a second walker position wherein the walker portion is pivoted rearwardly away from the body so that the rider portion is retracted through the opening in the body.

2. The walker/rider toy of claim 1 further comprising a latch assembly mounted on said chassis, a first latch opening in said handlebar, and a second latch opening in said handlebar, said latch assembly selectively releasably engaging with said first latch opening for latching said body and said handlebar in said rider position, said latch assembly selectively releasably engaging with said second latch opening for latching said handlebar and said body in said walker position.

3. The walker/rider toy of claim 1 wherein said body includes a contoured upper surface that is configured and arranged to form a seat for a child when the body and handlebar are locked in the rider position.

4. The walker/rider toy of claim 2 wherein said body includes a contoured upper surface that is configured and arranged to form a seat for a child when the body and handlebar are in the rider position.

5. The walker/rider toy of claim 1 wherein said chassis and said body include arcuate recesses on opposing sides thereof for accommodating the legs of child when the body and handlebar are in the rider position.

6. The walker/rider toy of claim 1 wherein said walker portion of said handlebar extends rearwardly beyond t rear end of the body.

7. The walker/rider toy of claim 1 wherein said chassis and said body are wider at the rear ends thereof than at the front ends thereof.

8. The walker/rider toy of claim 1 wherein said chassis is generally V-shaped, and said chassis and said body are wider at the rear ends thereof than at the front ends thereof.

9. The walker/rider toy of claim 1 wherein said plurality of wheels comprise four wheels, each respectively located in symmetrical relation on opposing sides of said chassis at the front and rear ends thereof.

10. The walker/rider toy of claim 2 wherein said plurality of wheels comprise four wheels, each respectively located in symmetrical relation on opposing sides of said chassis at the front and rear ends thereof.

11. A convertible walker/rider toy for a child comprising:

a chassis having front and rear ends;

a plurality of wheels attached to said chassis for rotatably supporting said chassis on a supporting surface;

a body having front and rear ends, said body being pivotally attached to said chassis adjacent said front end of said chassis; and a handlebar having a walker portion and a rider portion which are joined in an L-shaped configuration, said walker portion of said handlebar being pivotally attached to said body adjacent said rear end of said body, said rider portion of said handlebar being received through an opening in the body adjacent the front end of the body, said toy being convertible between a rider configuration wherein said body at least partially overlies said chassis and further wherein the walker portion of the handlebar extends beneath the body between the body and the chassis and the rider portion of the handlebar projects upwardly through the opening in the front end of the body, and a walker configuration wherein the rear end of the body is pivoted upwardly so that the chassis and the body are disposed at an angle and further wherein the walker portion of the handlebar is pivoted rearwardly away from the body and the rider portion is retracted through the opening in the body.

12. The walker rider toy of claim 11 further comprising a latch for alternately latching said toy in said rider configuration and said walker configuration.

13. The walker/rider toy of claim 11 further comprising a latch assembly mounted on said chassis, a first latch opening in said handlebar, and a second latch opening in said handlebar, said latch assembly selectively releasably engaging with said first latch opening for latching said body and said handlebar in said rider configuration, said latch assembly selectively releasably engaging with said second latch opening for latching said handlebar and said body in said walker configuration.

14. The walker/rider toy of claim 11 wherein said body includes a contoured upper surface that is configured and arranged to form a seat for a child when the toy is in the rider configuration.

15. The walker/rider toy of claim 11 wherein said chassis and said body include arcuate recesses on opposing sides thereof for accommodating the legs of child when the toy is in the rider configuration.

16. The walker/rider toy of claim 11 wherein said walker portion of said handlebar extends rearwardly beyond the rear end of the body.

17. The walker/rider toy of claim 11 wherein said chassis and said body are wider at the rear ends thereof than at the front ends thereof.

18. The walker/rider toy of claim 11 wherein said chassis is generally V-shaped, and said chassis and said body are wider at the rear ends thereof than at the front ends thereof.

19. The walker/rider toy of claim 11 wherein said plurality of wheels comprise four wheels, each respectively located in symmetrical relation on opposing sides of said chassis at the front and rear ends thereof.

20. The walker/rider toy of claim 12 wherein said plurality of wheels comprise four wheels, each respectively located in symmetrical relation on opposing sides of said chassis at the front and rear ends thereof.

* * * * *